US005467511A

United States Patent [19]

Kubo

[11] Patent Number: 5,467,511

[45] Date of Patent: Nov. 21, 1995

[54] SHOELACE FASTENING DEVICE

[75] Inventor: Yoshihiro Kubo, Osaka, Japan

[73] Assignee: Morito Kabushiki Gaisha, Osaka, Japan

[21] Appl. No.: 229,941

[22] Filed: Apr. 19, 1994

[30] Foreign Application Priority Data

Dec. 6, 1993 [JP] Japan ..... 5-065031 U

[51] Int. Cl.[6] ..... F16G 11/00

[52] U.S. Cl. ..... 24/712.9; 24/712.1; 24/713.2

[58] Field of Search ..... 24/712.9, 712.1, 24/712.2, 713.2, 713.3, 713.4, 714.6

[56] References Cited

U.S. PATENT DOCUMENTS

| | | | |
|---|---|---|---|
| 423,808 | 3/1890 | Potts | 24/712.9 |
| 493,202 | 3/1893 | Abney | 24/712.9 |
| 730,031 | 6/1903 | Leopold | 24/712.1 |
| 1,094,262 | 4/1914 | Spangenberg | 24/712.9 |
| 1,629,684 | 5/1927 | Haan | 24/712.9 |
| 2,038,851 | 4/1936 | Nagamatsu | 24/712.9 |
| 4,648,159 | 3/1987 | Dougherty | 24/713.2 |
| 5,158,428 | 10/1992 | Gessner et al. | 24/712.9 |

FOREIGN PATENT DOCUMENTS

| | | | |
|---|---|---|---|
| 0035830 | 1/1906 | Switzerland | 24/712.1 |

*Primary Examiner*—Victor N. Sakran

*Attorney, Agent, or Firm*—Armstrong, Westerman Hattori, McLeland & Naughton

[57] ABSTRACT

A shoelace fastening device to be mounted on each side of the instep of a shoe in the vicinity of the corresponding end portion of a shoelace for fastening the shoelace end reliably by a single action. The shoelace fastening device comprises: a mounting base; a lace holder guide mounted on said mounting base; and a lace fastener body mounted on said mounting base in juxtaposition to said lace holder guide and formed with a lace clamping groove which has a V-shaped section extending from the side of said lace holder guide to the opposite side and which is formed in the facing inner surfaces thereof with a multiplicity of ridges inclined upward from the side of said lace holder guide to the opposite side to form a v-shaped opening.

4 Claims, 2 Drawing Sheets

Fig.1
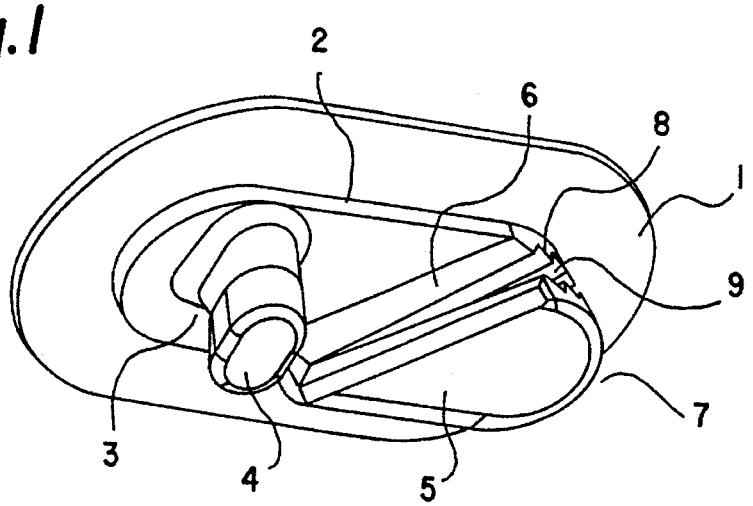
Fig.2
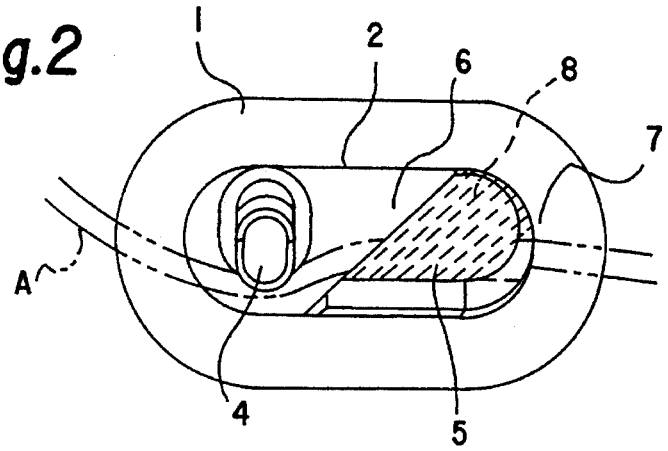
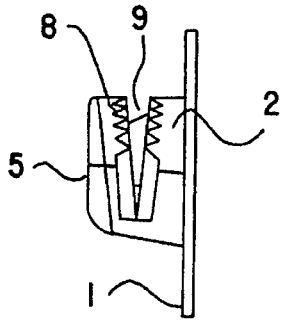
Fig.4
Fig.3
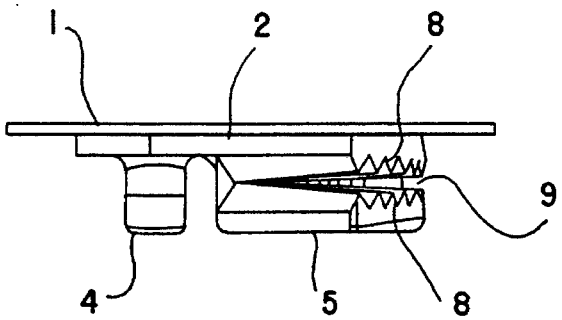

SHOELACE FASTENING DEVICE

BACKGROUND OF THE INVENTION

1. Field of the Invention

The present invention relates to a shoelace fastening device to be mounted on a shoe of lace-fastened type For Fastening the shoe on the instep with the lace.

2. Description of the Related Art

In a shoe of lace-fastened type of the prior art, the shoelace ls threaded sequentially into the lace holes or rings, which are arranged on the two sides of the shoe instep, and is tied to each other at its two end portions.

However, the lace-fastened shoe has its lace tied at the two end portions so that its lace has to be long and seriously troublesome to tie. Even in case the lace is tied, there remains problems to be solved in that a bowknot rises on the instep and that the lace get loose and is stepped, if tied loosely, and is hard to untie if tied Firmly or in an overhand knot.

SUMMARY OF THE INVENTION

An object of the present invention is to provide a shoelace Fastening device which can not only lace a lace-fastened shoe reliably by a single action without knotting the lace but also untie the lace by a simple action.

According to an aspect of the present invention, there Is provided a shoelace fastening device comprising: a mounting base; a lace holder guide mounted on said mounting base; and a lace fastener body mounted on said mounting base in juxtaposition to said lace holder guide and formed with a lace clamping groove which has a V-shaped section extending from the side of said lace holder guide to the opposite side and which is formed in the facing inner surfaces thereof with a multiplicity of ridges inclined upward from the side of said lace holder guide to the opposite side to form a v-shaped opening.

The shoelace fastening device thus constructed is fixed for use to the vicinity of the trailing end portion of each of rows of the lace holes or rings arrayed on the shoe instep. The shoelace is pulled and hooked at its end portion by the lace holder guide. After this, the lace end portion is clamped in the ace clamping groove and is released from the pulling force. Then, the lace is returned in the lace clamping groove by its elastic shrinkage or slackness. However, since the groove has the V-shaped section and is formed in its inner surfaces with the numerous ridges inclined upward from the side of the lace holder guide to the opposite side, the lace is fitted between the ridges and the facing groove bottoms so that it is reliably clamped and blocked against its movement in the loosening direction.

According to the present invention, therefore, the shoe can be reliably fastened by the single action without knotting the lace. In case the lace is to be untied, it may be moved, while being slightly pulled, toward the opening side of the lace clamping groove. Thanks to this simple action but without no knotting action, the lace can be economically short. Moreover, it is possible to solve the problems of the prior art that a bowknot rises on the instep and that the lace gets loose and is stepped, if tied loosely, and is hard to untie if tied firmly or in an overhand knot.

BRIEF DESCRIPTION OF THE DRAWINGS

FIG. 1 is a perspective view showing a shoelace fastening device according to the present invention;

FIG. 2 is a front elevation showing the shoelace fastening device;

FIG. 3 is a top plan view showing the shoelace fastening device;

FIG. 4 is a righthand side elevation showing the shoelace fastening device.

DESCRIPTION OF THE PREFERRED EMBODIMENT

Figure 5:
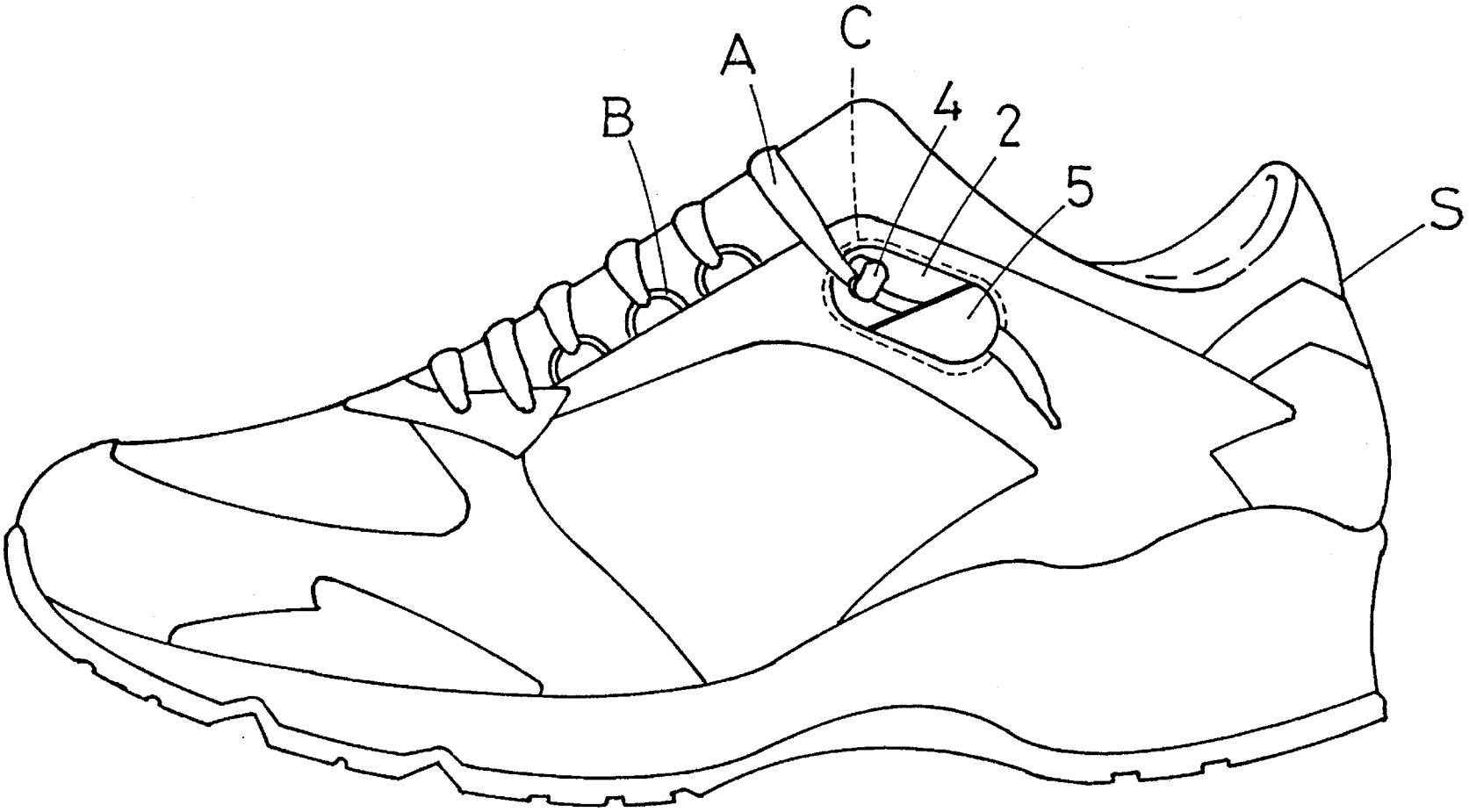
FIG. 5 is a side elevation showing an example of a shoe which is equipped with the shoelace fastening device according to the present invention.

A shoelace fastening device according to the present invention is made of a synthetic resin such as ABS, nylon, urethane or polypropylene. A mounting base 1 thinned to be mounted on a shoe is formed thereon with a platform 2. A lace holder guide 4 formed with a lace hooker 3 at its middle column portion and a lace fastener body 5 are integrally molded on the platform 2 in juxtaposition to each other. The lace fastener body 5 is formed with a lace clamping groove 9 which has a V-shaped section having an opening angle of 5 to 40 degrees and extending from the side 6 of the lace holder guide 4 to the opposite side 7. The lace clamping groove 9 is formed in its facing inner surfaces with a number of ridges 8 which are inclined upward from the lace holder guide side 6 to the opposite side 7. The lace clamping groove 9 has its V-shaped opening in its side opposed to the lace hooker 3.

The shoelace fastening device thus constructed is used, as shown In FIG. 5, by fixing it on each of the sides of the instep of a shoe S in the vicinity of the terminal portion of the corresponding one of the rows of lace holes or rings B, which are arrayed along the shoe instep.

If, in this case, the instep member of the shoe is formed with a hole sized equally to the platform 2, the shoelace fastening device has its platform 2 fitted in the hole and its mounting base 1 stitched, as at C, around its periphery to the instep member. Then, the platform 2 is effective to facilitate the positioning when the shoelace fastening device is to be mounted.

When a shoelace A is to be fastened, moreover, it is pulled and hooked at its end portion on the lace hooker 3 of the lace holder guide 4. After this, the lace A is inserted into the opening of the lace clamping groove 9 and is released from the pulling action. Then, the lace A is going to return in the lace clamping groove 9 toward the lace holder guide side 6 by its elastic shrinkage or slackness. However, since the lace clamping groove 9 has the V-shaped section and is formed in its inner surfaces with the numerous ridges 8 inclined upward from the lace holder guide side 6 to the opposite side 7, the lace A is fitted between the ridges 8 and the facing groove bottoms so that it is blocked against its movement in the loosening direction.

Incidentally, the foregoing embodiment uses the synthetic resin but can employ a metal such as aluminum or ceramics.

Moreover, the lace holder guide 4 may be made of a metallic material whereas the lace fastener body 5 may be made of a synthetic resin and separately of the lace holder guide 4, and these two members 4 and 5 may be individually equipped with the mounting base 1. In this modification, the shoelace fastening device of the present invention can be manufactured by a simple mold. For use, the lace fastening function can be improved by fixing the lace holder guide 4 in a position different from the lace fastener body 5.

Still moreover, the lace holder guide 4 is made separate but of the same material as that of the lace fastener body 5 can be inserted from the back to the surface into the hole of lace fastener body 5, which is formed through a portion extended from the mounting base 1. and can be fixed to the lace fastener body 5.

Furthermore, the lace clamping groove 9 having the V-shaped section can have a bottom curved to have a U-shaped section so that the strength in case the lace clamped by the lace clamping groove 9 can be retained to prevent the ]ace fastener body 5 from breaking.

What is claimed is:

1. A shoelace fastening device comprising: a mounting base; a lace holder guide mounted on said mounting base, said lace holder guide having a lace holder at a middle column portion; and a lace fastener body mounted on said mounting base in juxtaposition to said lace holder guide and formed with a lace clamping groove which has a V-shaped section extending from the side of said lace holder guide to the opposite side and which is formed in the facing inner surfaces thereof with a multiplicity of ridges inclined upward from the side of said lace holder guide to the opposite side to form a V-shaped opening.

2. A shoelace fastening device according to claim 1, wherein said lace holder guide and said lace fastener body are separately mounted on said mounting base.

3. A shoelace fastening device according to claim 2, wherein said lace holder guide is made separate and is inserted from the back to the surface into the hole of said lace fastener body, which is formed through a portion extended from said mounting base, and fixed to said lace fastener body.

4. A shoelace fastening device according to claim 1 or 2, wherein said lace clamping groove having the V-shaped section has a bottom curved to have a U-shaped section.

* * * * *